US007681619B2

(12) United States Patent
Ramin et al.

(10) Patent No.: US 7,681,619 B2
(45) Date of Patent: Mar. 23, 2010

(54) ENERGY-SAVING AUTOMATIC WINDOW OBTAINED BY USING SOLAR ENERGY DURING THE COLD SEASON, CONTROL OF SOLAR RADIATION IN SUMMER, THERMAL INSULATION, CONTROLLED INTERNAL INCIDENCE OF LIGHT, CONTROLLED AIR EXCHANGE

(76) Inventors: Filippo Ramin, 9 Via Chiesa, Terlano (IT) 39018; Norbert Felderer, 15 Via Montessa, Sarentino (IT) 39058

( * ) Notice: Subject to any disclaimer, the term of this patent is extended or adjusted under 35 U.S.C. 154(b) by 333 days.

(21) Appl. No.: 10/598,547

(22) PCT Filed: Mar. 2, 2005

(86) PCT No.: PCT/IT2005/000115

§ 371 (c)(1),
(2), (4) Date: Jun. 24, 2007

(87) PCT Pub. No.: WO2005/085577

PCT Pub. Date: Sep. 15, 2005

(65) Prior Publication Data

US 2008/0263972 A1 Oct. 30, 2008

(30) Foreign Application Priority Data

Mar. 5, 2004 (IT) ..... BZ2004A0009

(51) Int. Cl.
*E06B 3/32* (2006.01)

(52) U.S. Cl. ..... 160/107; 52/173.3; 49/122; 49/96; 49/63

(58) Field of Classification Search ..... 160/107; 52/173.3; 49/68, 61, 62, 63, 65, 98, 94, 95, 49/96, 116, 118, 122
See application file for complete search history.

(56) References Cited

U.S. PATENT DOCUMENTS

| | | | | | |
|---|---|---|---|---|---|
| 1,352,971 | A | * | 9/1920 | Kellogg | 49/98 |
| 2,226,274 | A | * | 12/1940 | Winship | 49/65 |
| 3,584,413 | A | * | 6/1971 | Abrami et al. | 49/5 |
| 3,676,955 | A | * | 7/1972 | Schacht | 49/192 |
| 3,845,585 | A | * | 11/1974 | Cecil | 49/139 |
| 3,925,945 | A | * | 12/1975 | White | 165/48.2 |
| 4,073,224 | A | * | 2/1978 | Bierlich | 454/213 |
| 4,081,934 | A | * | 4/1978 | Franz | 52/171.3 |

(Continued)

FOREIGN PATENT DOCUMENTS

EP 0978617 2/2002

(Continued)

*Primary Examiner*—Katherine W Mitchell
*Assistant Examiner*—Philip S Kwon
(74) *Attorney, Agent, or Firm*—Themis Law

(57) ABSTRACT

The present invention relates to an automatic window system consisting of a frame, two movable window casements, one on the outside and one on the inside of a building, and of a mechanism, which opens and closes the afore-mentioned window casements independently of each other. Glass panels having certain physical and optical properties may also be included, as well as a motor-driven blind and a rolled curtain, which together regulate the climate and temperature of the building. In one embodiment, the heat flow between the glass panels can be manipulated.

36 Claims, 6 Drawing Sheets

U.S. PATENT DOCUMENTS

| | | | | |
|---|---|---|---|---|
| 4,274,469 | A * | 6/1981 | Kuyper et al. | 160/107 |
| 4,369,828 | A * | 1/1983 | Tatro | 160/107 |
| 4,538,662 | A * | 9/1985 | Tomita | 160/107 |
| 4,877,076 | A * | 10/1989 | Komori et al. | 160/107 |
| 4,884,613 | A * | 12/1989 | Komori et al. | 160/107 |
| 5,325,579 | A * | 7/1994 | Baier | 29/462 |
| 5,365,990 | A * | 11/1994 | Ueda | 160/23.1 |
| 5,535,550 | A * | 7/1996 | Yang | 49/163 |
| 6,094,306 | A | 7/2000 | Jain | |
| 6,748,700 | B1 * | 6/2004 | McAllister | 49/119 |
| 2006/0130980 | A1 * | 6/2006 | Gromotka et al. | 160/107 |
| 2006/0151129 | A1 * | 7/2006 | Van Klompenburg et al. | 160/107 |
| 2007/0017644 | A1 * | 1/2007 | Berger | 160/107 |
| 2007/0144684 | A1 * | 6/2007 | Hutchings et al. | 160/107 |
| 2008/0040990 | A1 * | 2/2008 | Vendig et al. | 52/173.3 |

FOREIGN PATENT DOCUMENTS

| | | |
|---|---|---|
| EP | 1273752 | 1/2003 |

* cited by examiner

B-B

A-A

ENERGY-SAVING AUTOMATIC WINDOW OBTAINED BY USING SOLAR ENERGY DURING THE COLD SEASON, CONTROL OF SOLAR RADIATION IN SUMMER, THERMAL INSULATION, CONTROLLED INTERNAL INCIDENCE OF LIGHT, CONTROLLED AIR EXCHANGE

FIELD OF THE INVENTION

The present invention relates to window systems. More particularly, the present invention relates to an automatic window system for saving energy which employs sun energy during the colder season, controlled solar radiation during the warmer season, thermal insulation, controlled incidence of light into the inside of the building, and controlled air exchange.

BACKGROUND OF THE INVENTION

The state of the art for energy saving windows is described in different documents, such as patents DE 296 24 245 U1 and EP 0978617B1 and includes designs, which enable on the one hand a mechanism for the parallel opening of the window casement or, on the other hand, the use of sun energy during the winter, for example, as in patent IT 01/00026.

BRIEF SUMMARY OF THE INVENTION

The present invention has the object of creating conditions for an efficient control of the climate and temperature of a building, which is primarily influenced glass surfaces in the building. The object of the present invention is achieved through a window design, which uses simple components and mechanisms.

In one embodiment, the window system consists of a frame, which supports a frame and a counter-frame of the window and/or is part of the support frame of the building, an outer and an inner window casement, which are glazed and independent of each other, and a mechanism for opening and closing the window casements independently of each other. Each of these two window casements consists of a profile with a variable heat transition efficient of preferably U=0.8 to 0.6 $W/m^{2\circ}$ K.

The outer glass pane consists of insulating glass with suitable physical and optical characteristics, a variable heat transition efficient of preferably U=1.6 to 1.1 $W/m^{2\circ}$ K., as well as a variable transparency coefficient of preferably 68% to 77% with a corresponding transmission of sun energy. Inside the outer insulating glass pane is a blind or a type of curtain on rolls, consisting of a material with variable thermal conductivity of preferably $\lambda$=0.014 to 0.0126 W/m° K. The blind and the curtain are driven by a motor. The inner glass pane consists of insulating glass with suitable physical and optical characteristics, and has a variable heat transition coefficient of preferably U=0.6 to 0.3 $W/m^{2\circ}$ K. For both individual insulating glass panes, spacers are foreseen which—in comparison to other systems—change the thermal conductivity to achieve better insulation along the perimeter of the insulating glass pane.

The features described herein provide a window system, which—depending on the external climatic conditions—creates a better indoor climate. One mode of operation of a window according to the present invention is as follows: during the wintertime, when the sun shines on the glass surfaces of a building, the outer window casing with the movable blind or the rolled up curtain stays closed, while the inner window casing can be opened parallel to the outer window casing towards the inside. The energy of the sun, which enters the building through the outer insulated glass pane, first warms up the inside of the window and then, by convection, warms up the air near the glass surface and, in turn, the entire room. One part of the sun's energy goes straight through both glass surfaces, which warms up the room directly.

During the summer, in order to control the solar radiation, the inner window casement stays closed to provide insulation, and the outer window casement—with the blind or the curtain rolled down—will be opened to the outside. This way, the open window casement forms a barrier against solar radiation. The separation of the outer and inner glass panes enables the direct and complete release of heat, which is collected on the outside glass pane, to the air on the outside, so that the inner insulated glass pane warms up.

The heat insulation of the window is at its best, when both window casements—with the blind or the curtain down—are fully closed and as far as the circumstances allow, the previously described mode of operation is implemented. When the blind or the curtain are down, the thermal insulation of the outer insulated glass pane can be improved.

During the cold season and when both window casements are closed, window insulation can be improved by altering thermal conduction inside the window casements. This involves installing a conduit along an inner side wall, visible between both insulating glass units. This pipeline contains a liquid, which is normally used for heating and cooling purposes, and runs through the frame. This application is appropriate if the energy necessary for it can be taken from known or renewable energy sources, e.g. from the storage of a solar unit or from passive existing heat sources from pipelines underneath the ground, or from below the building where there may be liquids of suitable temperatures and quantities, or from a combination thereof. This design warms up the air between both insulating glass casements, which results in a better insulation of the inner insulating glass casement and of the surrounding components of the window.

Therefore, the contribution of solar energy, which is necessary to change the thermal flow of the insulating glass panes, depends also on the coefficients of thermal conduction of the inner and outer casements containing the glass panes when these are closed or by providing the necessary conditions for the desired thermal flow to occur. The air exchange is achieved by opening, for a certain period of time, one window casement to the outside and the other towards the inside of the building. The incidence of light is controlled by the motor-driven blind and/or the relevant curtain on rollers inside the inner insulating glass unit. All possible positions of both window casements (open/closed) are programmable; so are the climate data, which is received via sensors on the inside and outside of the windows. The processed data is also used for manoeuvring the control mechanism to the required positions.

One feature of a window according to the present invention is that the frame and the window casements are completely disposed on the inside of the window, between the insulating glass panes. Therefore, heat conductivity, which is affected by the frame and the window casements, is increased, because these components are enclosed between the insulating glass panels, which adds to the insulation through the glass panels the specific insulation of the frame and of the window casements.

To maximize energy saving and insulation, a ventilator mechanism is placed inside the unit and is visible between the two window casements. In this embodiment, the entire perimeter, the frame parts, the window encasements and the glass panels have a more homogeneous temperature, without superimposed mechanisms for the automatic opening of the window panels. Furthermore, by positioning pipelines for warming up and/or cooling down the inside of the windows, which are also visible through both glass panels, the frame parts, window casements and glass panels retain a homogeneous structure. An even greater energy saving is achieved by using electric engines, which have a low energy requirement.

The present invention involves the use of multiple hinges, which hold the weight of the window casement during the opening and closing phase, which otherwise would be actuated by the electric engines, thereby minimizing electricity consumption.

DETAILED DESCRIPTION OF THE SEVERAL VIEWS OF THE DRAWINGS

In the following detailed description, the invention is described in detail with reference to different embodiment and to the figures, in which.

DETAILED DESCRIPTION OF EMBODIMENTS OF THE INVENTION

Figure 2:
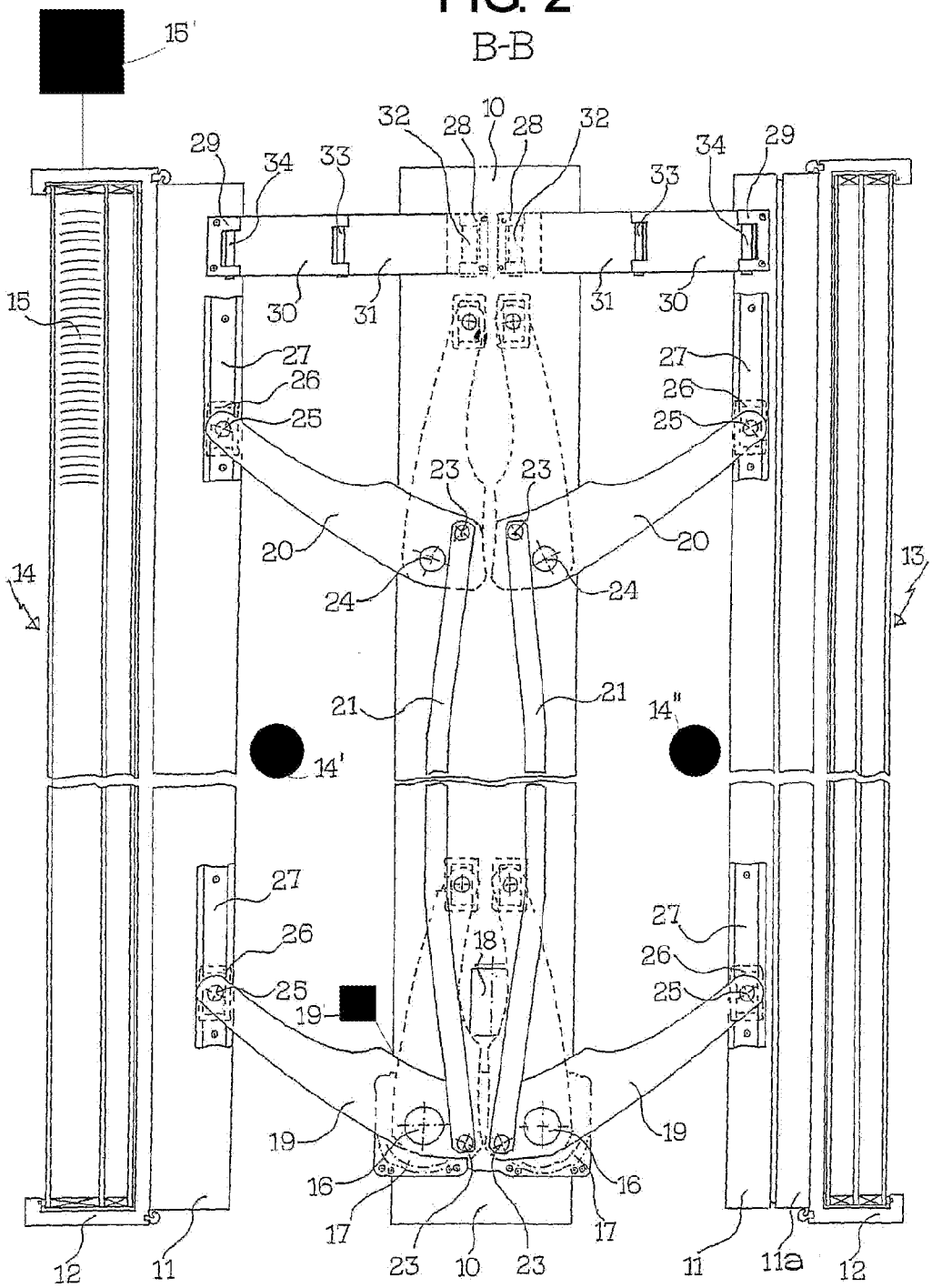
FIG. 2 is a longitudinal cross-sectional view of the window of FIG. 1.
Figure 3:
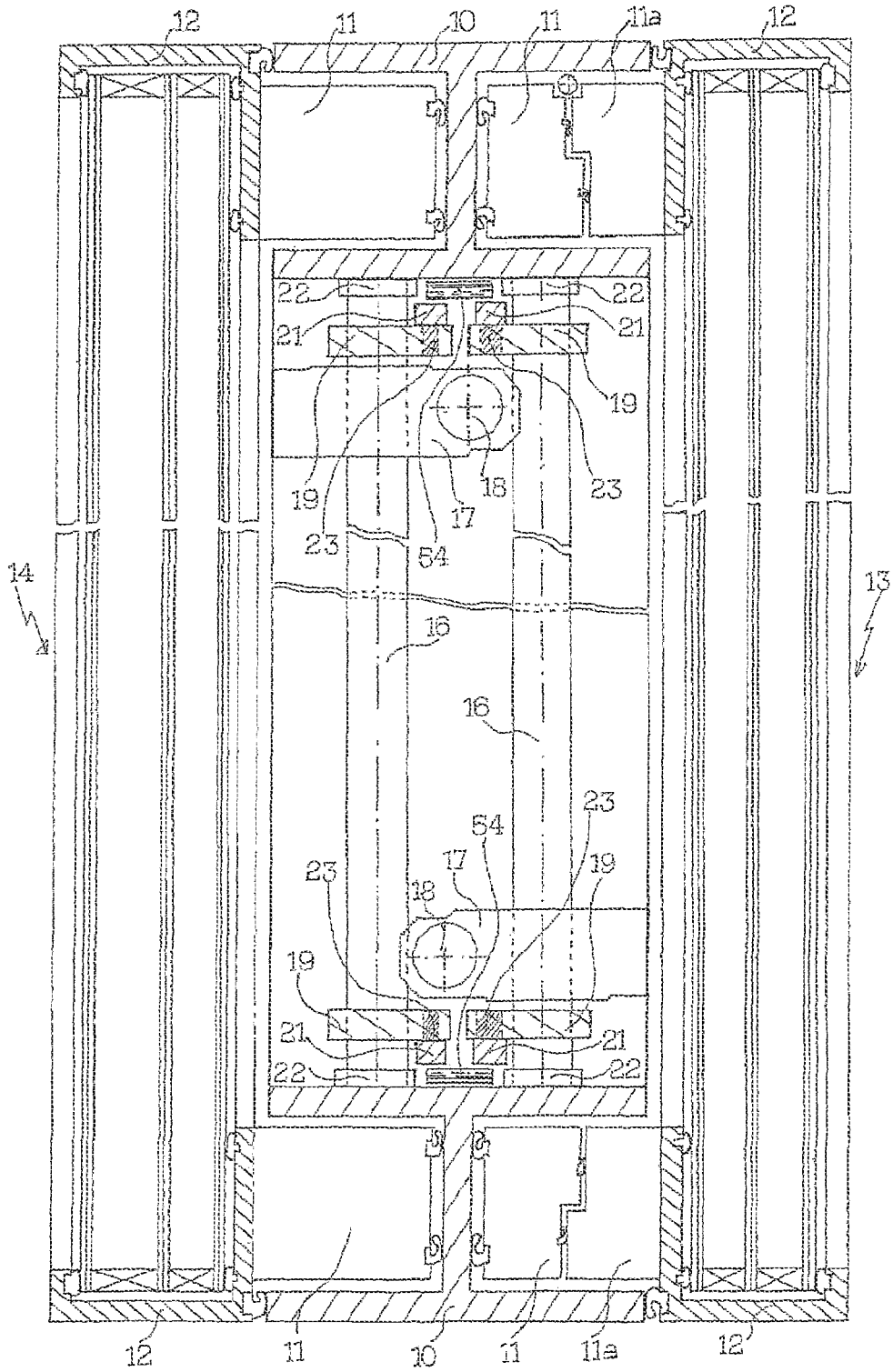
FIG. 3 is a lateral cross-sectional view of the window of FIG. 1.
Figure 3A:
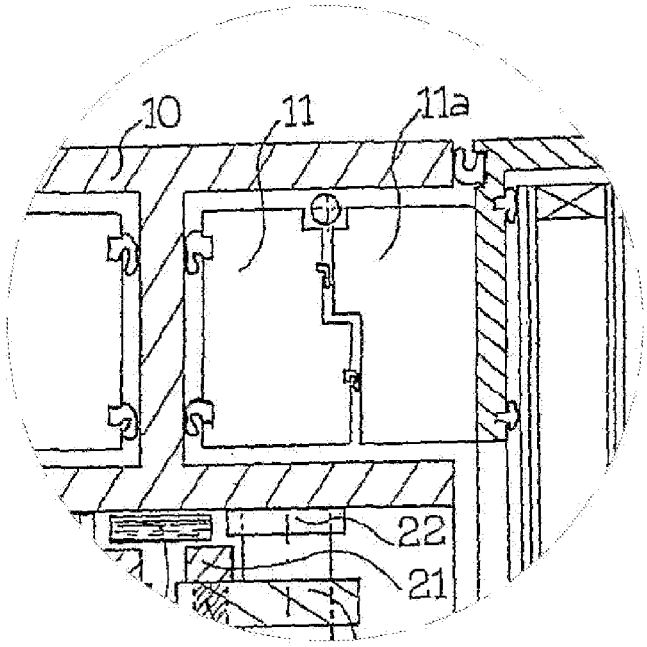
FIG. 3A is a detail view of FIG. 3 showing two seperable mating parts.
Figure 4:
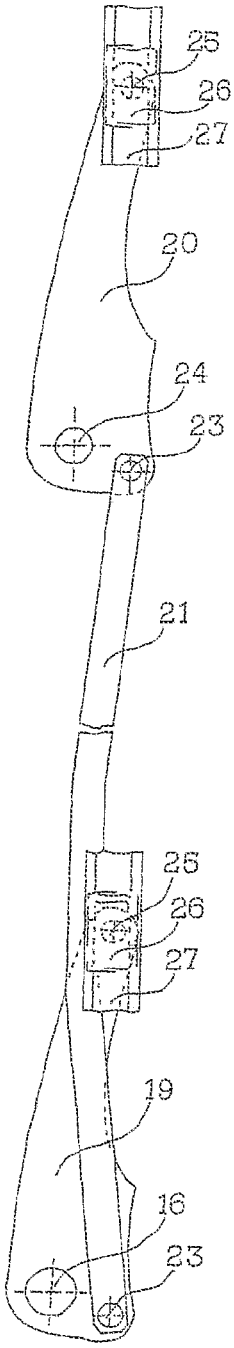
FIG. 4 is a front view of the levers and connecting rods in one embodiment of the invention.

The frame of a window in an embodiment of the invention consists of a rolled I (FIG. 3; 2; 1) 10 or U profile, which stretches over the entire perimeter. The profile is designed to incorporate the complementary volume formed into the resulting hollow space, which is restricted by the configuration as a I or U or the configuration as a L, C or T. The I profile has to fulfil the task of the frame and of the counter frame and can also represent the support structure of the building. A hollow space of the I profile, in which there is a window casement (FIG. 3; 2) 11, is disposed towards the outside of the building, which forms the entire outside of the window. The outer insulating glass (FIG. 3; 2) 14 with the motor-driven blind (FIG. 2) 15 in the inside, is fixed with a special profile onto the window casement (FIG. 3; 2; 1) 12. The motor driving the blind is identified with numeral 15'. The result is that the outer insulating glass conceals the window casement and the window casement conceals the frame. Opposite and symmetrical, inside the hollow space of the I profile, is a window casement, which forms the entire inside of the window (FIG. 3; 2; 1) 11; 11*a*. The inner insulating glass (FIG. 3; 2) 13 is linked to the window casement by a special profile (FIG. 3; 2) 12. This enables the inner insulating glass to conceal the window casement and the window casement conceals the frame. The inner window casement forms a unit consisting of two components, which may be configured as two mating parts: one part functioning as a frame (FIG. 3; 2) 11 and on the other side (FIG. 3; 2; 1) 11*a*, with insulating glass, the opening part of the window. If the inner window casement is completely opened manually, it enables cleaning of the inner glass panels, access to the opening mechanism, the direct release of the solar energy into the room, a better light transmission, as well as an increased exchange of air, in case the outer window casement has also been opened. FIG. 3A provides a detail view of parts 11, 11*a* that are separable through manual actuation.The inner window casement comprises a plurality of mating parts, a first mating part of the plurality of mating parts being affixed to the frame and a second mating part of the plurality of mating parts being movable from the first part, wherein the plurality of mating parts are separable manually. The window panes are made of insulating glass, wherein the insulating glass comprises two parallel glass sheets spaced one from the other, further comprising a conduit disposed within a space between the two glass sheets, the conduit heating or cooling the space, wherein the conduit heats or cools the space by the temperature differential between the space and a liquid flowing in the conduit.

All window casements are provided with suitable safety mechanisms and standard catches and gaskets. For the manually opened window casement, a simple opening and closing mechanism is intended to be used, which has not been graphically illustrated. It should consist of snap-in pins and a holding lever, which are fixed to the specific profile in a suitable place.

The mechanism of the automatic window system consists at least of: two independent drive shafts (FIG. 3; 2; 1) 16, two independent driving motors (FIG. 3; 2; 1) 17, eight levers of the same size (FIG. 3; 2; 1) 19; 20 plus four connecting rods (FIG. 3; 2; 1) 21, four multiple hinges (FIG. 2; 1) 30-31, which support the weight of the outer and inner window casements. The drive shafts (FIG. 3; 2; 1) 16 end on both sides in a holder (FIG. 3; 1) 22, which is supplied with a receptacle, in order to permit movement in the shafts in both directions. The holders 22 are fixed to the frame.

Figure 1:
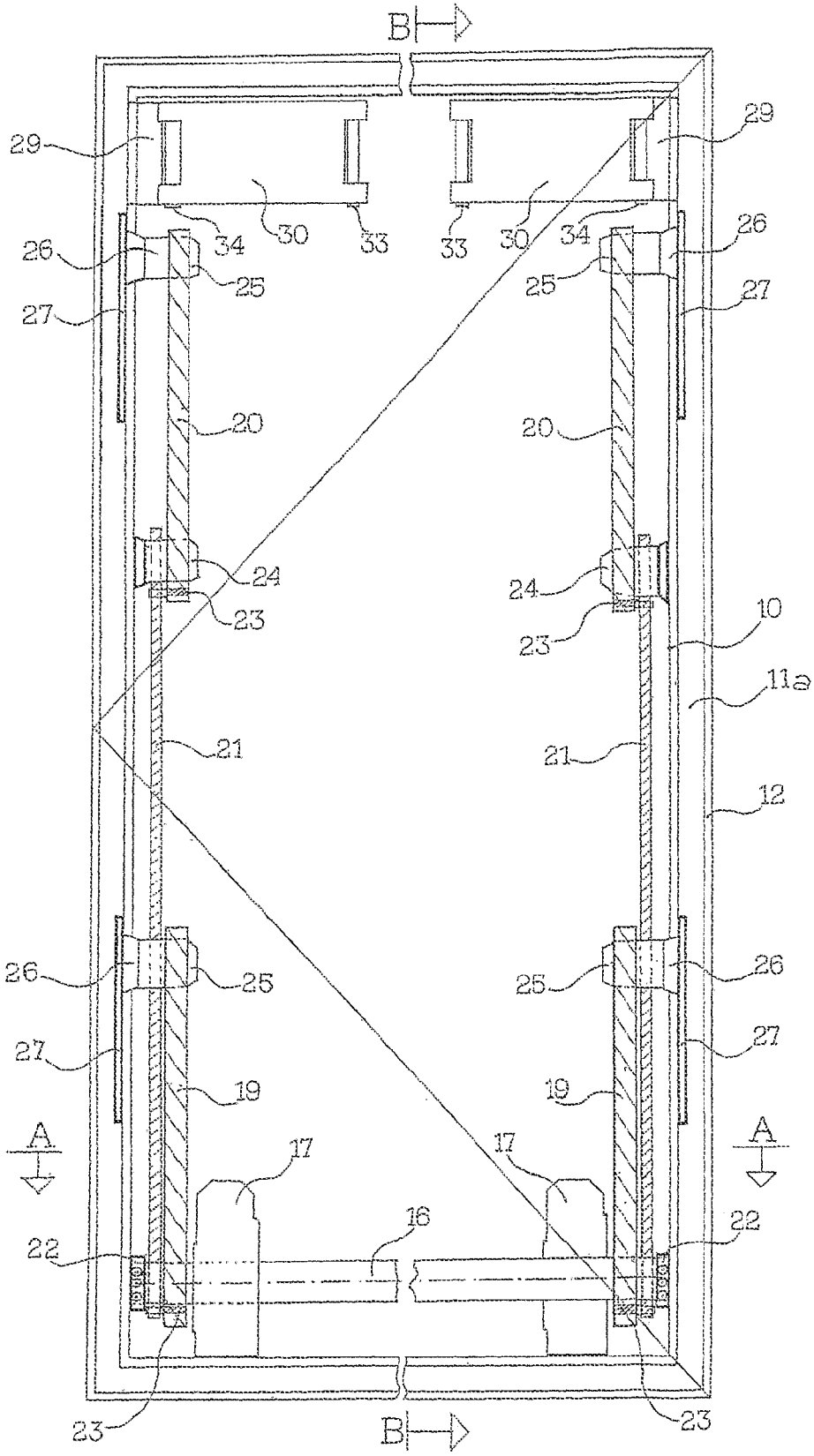
FIG. 1 is a front view of an embodiment of a window according to the present invention.

The drive shafts with the ability to move independently (FIG. 3; 2; 1) 16 are arranged in parallel. Each drive shaft is fixed firmly to two levers, (FIG. 1; 2; 3) 19. The rotation surface runs at right-angles to the axle of the drive shaft. An independent driving motor 17 is connected to each drive shaft (FIG. 1; 2; 3), which is fixed to the frame. From the frame or the counter-frame to the drive shaft, the order of components is as follows: on one end is the holder of the drive shaft, which is connected to the frame; the opening lever, which is connected to the driving shaft, as well as the driving motor, which is connected to the continuous drive shaft. Each action lever may be coupled to the inner and outer casements via a piston system 19'.

All levers have three different openings on the surface of the rotation level. Two openings are in one place, defined here as at the lower end of the lever, and one opening at the upper end. In four of these levers (FIG. 3) 19, two for each drive shaft, one of the two openings at the lower end is used for coupling to the drive shaft (FIG. 1; 2; 3; 4) 19 and the other, second opening is used for fixing a rotating pin 23, to which a connecting rod 21 is connected in order to transmit movement. From the remaining four levers, defined here as auxiliary levers (FIG. 1; 2; 4) 20, one of the two openings at the lower end serves for fixing a rotating pin 24, which is connected to a rotating bracket, which in turn is connected to one of the frames. The other, second opening is used for fixing a rotating pin 23, which in turn is fixed to the connecting rod 21.

On each of the connecting rods, at each of their ends, at right-angles to the moving direction of the connecting rod, there is a pin. The connecting rod provides the coupling of both levers (FIG. 1; 2; 4) 19; 20. One end of the connecting rod is connected with the lever 19, which in turn is connected to the drive shaft 16. The other end is connected to the auxiliary lever 20. The connecting rods (FIG. 1; 2; 3; 4) 21, two each for one window casement and disposed vertically in relation to the windows, transmit the movement of the levers, which are connected to the drive shaft and to the auxiliary levers, which are controlled from the end of the connecting rods through rotating pins 23. This is made possible by starting the movement of opening lever (which is connected to the drive shaft) through the driving motor. This generates a rotating movement of the drive shaft. The opening levers move the auxiliary levers and create the same rotating movement of the auxiliary levers around the rotating pin (FIG. 1; 2; 4) 24.

Figure 5:
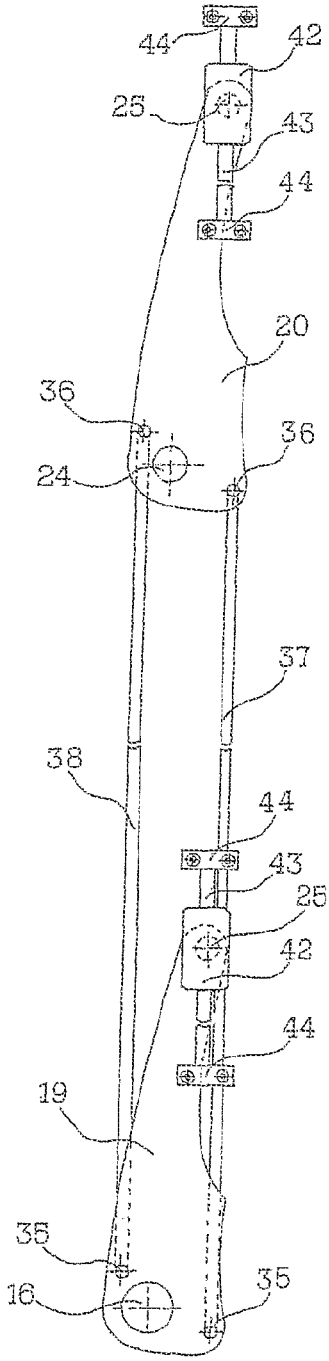
FIG. 5 is a front view of the levers and connecting ropes or profile rods in another embodiment of the invention.

As an alternative to connecting rods, the connection for the opening/closing levers can be achieved as follows:

(FIG. 5) Via parallel arranged ropes or profile rods 37; 38. At the lower end of the lever 19; 20 and near the rotation centre, there are two openings. They are situated in specific places along the surface of each lever. Inside the openings, there are parallel positioned ropes or profile rods 37; 38, which are connected to the lever via rotation pins 35; 36. As a result, the movement of the drive shaft lever 16 can be transferred onto the auxiliary lever 16. This happens through the tension/pressure of the ropes or profile rods 37; 38 during the rotating phase of the lever in both directions around drive shaft 16 and rotating pin 24.

Figure 6:
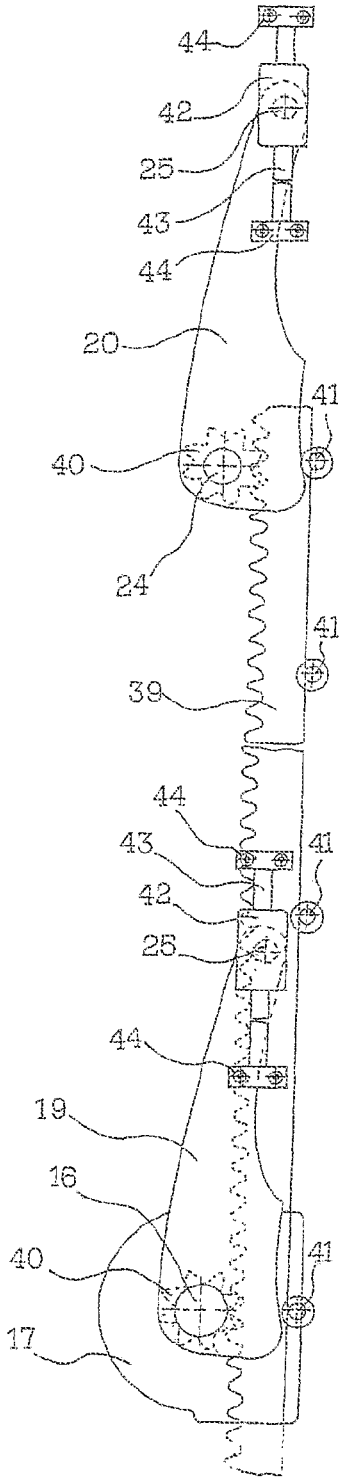
FIG. 6 is a front view of the levers and connecting toothed racks in still another embodiment of the invention.

(FIG. 6) Through a system consisting of toothed rack and pinion 39.

Using the position of drive shaft 16, keeping its relevant storage, and with gear 17, a pinion gear 40 is fixed to the lever of the drive shaft 16. The drive shaft 16 runs through lever 19 and the pinion gear 40. On the opposite side, an identical gear 40 is fixed to the auxiliary lever 20. The auxiliary lever 20 and the toothed wheel are fixed to the frame with a rotating pin 24. The toothed rack is fixed to the frame by special holders 41, which make shifting and a feed motion of the toothed rack possible, in both directions along the connecting rod. The toothed rod couples on the one side into the pinion gear of the drive shaft lever and on the other side into the pinion gear of the auxiliary lever. The driving motor brings forth a rotating motion of the drive shaft, which begins to move the pinion of the drive shaft lever and causes a movement of the toothed wheel along its own axle. This results in the movement of the pinion gear of the auxiliary lever 20, which is transferred to the lever 19.

All levers (FIG. 1; 2; 4) 19; 20 have an opening near one end, at the rotation centre. Inside this opening there is a rotating pin 25, which is connected to a bracket 26. Both are connected to the lever. The bracket is intended for a sliding movement in a guide block 27. The guide blocks 27 are fixed to the sides of the window casements and near the bracket 26 and are connected to the relevant levers.

According to an alternative design style of the bracket and of the guide block (FIG. 5; 6), a moving roller 42 is provided, which is movable along a profiled guide block 43, fixed on both ends to the two holders 44 on the window casements. According to another alternative design, each of the action levers is coupled to the inner or the outer casements via a piston system.

In order to guarantee the feed motion of the window casements on parallel levels and at right-angle to the level of the frame, the present embodiment includes an auxiliary mechanism, which consists of multiple hinges (FIG. 1; 2) 30-31. The drive shaft, set in motion by the driving motor, moves in both directions around its axle and results in the movement of the four levers, of which two are fixed to the drive shaft and two are auxiliary levers. Through the force produced by the levers (FIG. 1; 2; 4) 19; 20 and transmitted onto the bracket 26, the bracket 26 moves on the guide blocks 27 and at the same time the centers of the openings, which are at provided the upper ends of the lever on the opposite side of the rotating axles of the levers, move outwards while maintaining a parallel position in relation to the window casements. This solution makes it possible to move the window casement a little at a time and, thus, to open/close the window casement, either independently or both at the same time.

The support mechanism (FIG. 1; 2) for the opening of the window casement requires four multiple hinges 30-31, two for each window casement, which are visible inside the window near the auxiliary levers and connect to the frame and the counter-frame and the window casements.

Every multiple hinge 30-31 consists of two holders 28; 29, two straight elements, or 'wings' 30; 31, and three rotating pins 32; 33; 34, which hold the hinge together. The holders 28; 29 are connected at one end to the frame and the window casement. At the other end, the holders have segmented openings. There are segmented openings at both ends of the wings. The holder 28, which is connected to the frame, is connected at one end to the wing by a rotating pin 32, which is set into a segmented opening. The other end of the wing 31 is connected to the end of the second wing 32 by a second rotating pin 33, which is defined here as a central pin and which is disposed into the relevant segmented openings. The other end of the second wing 30 is connected to the other holder 29, which is fixed to the window casement, through a third rotating pin 34, which sits in the relevant segmented openings. The multiple hinges enable several movement positions, which occur via different axles.

The rotation of the multiple hinges (which consists of three elementary joints, of which one is fixed firmly to the frame) results in a horizontal movement of the multiple hinges, which is used to open and close the window casement. The force needed for moving the multiple hinges and the window casement is provided by the auxiliary levers 19, which are put in motion through the drive shaft 16 via the driving motor 17. In addition, the multiple hinges are a mechanical linkage, which—together with the levers—guarantee a movement of the window casements level with the frame.

During the closing of the window casement, the multiple hinges are compacted. During the opening of the window casement, the multiple hinges open like a book by positioning themselves at right-angles to the frame. The 'wings', from which the multiple hinges are made, are sufficiently large to enable the window casement to open completely.

Figure 7:
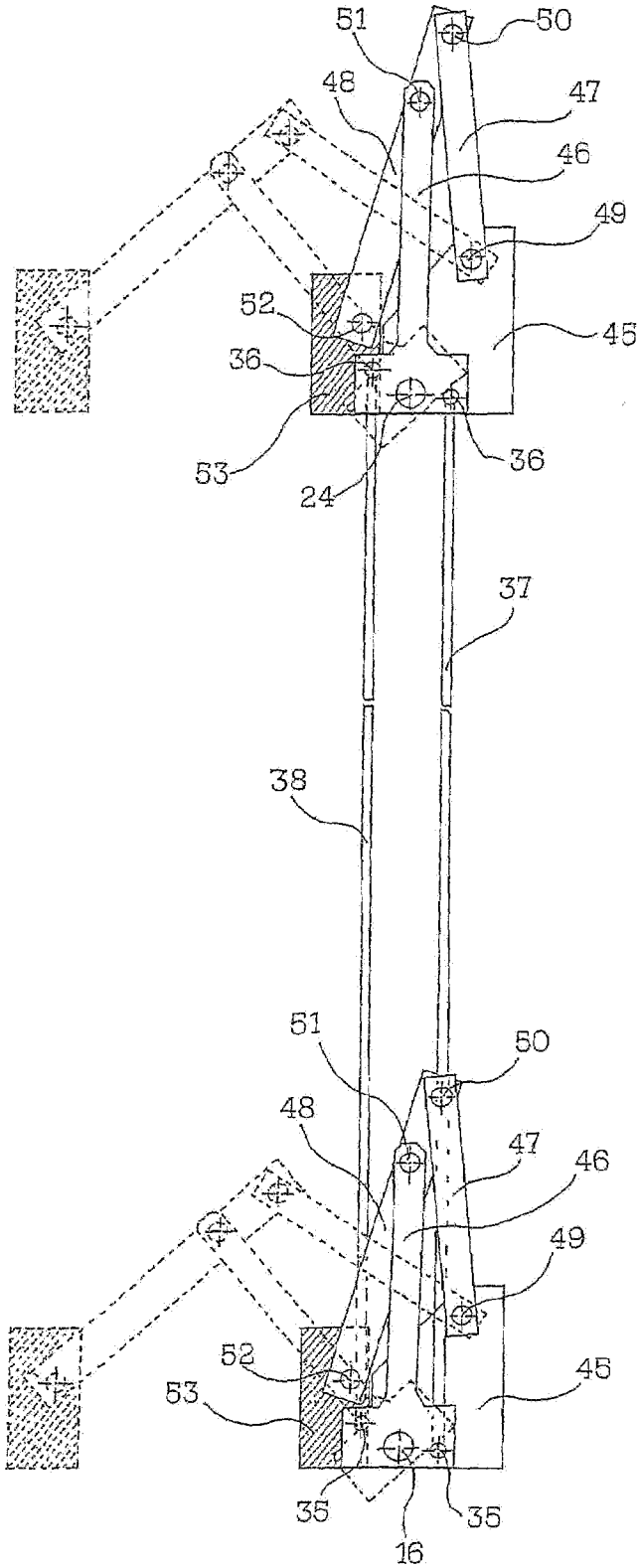
FIG. 7 is a front view of lever systems and connecting ropes or profile rods in yet another embodiment of the invention.

Another mechanical system (FIG. 7), which has the same purpose and function as the previous one and which enables the opening and closing of window casements, includes two holders, three levers and five joints. Altogether, these components form a 'lever system'. Each 'individual lever' of the previously described system is replaced by a 'lever system', so that every window casement has at least four 'lever systems'. This solution does not require the use of multiple hinges, brackets and guide blocks or swivel-joint roller bearings and profile guides. The main object of this mechanical system is to keep the configuration and intended execution of the previous model with the 'individual levers' and to ensure the connection between the individual lever systems through drive shafts, connecting rods, toothed rods, parallel arranged ropes or profile rods. The lever system (FIG. 7) consists of a special holder 45, which is fixed to the frame. Inside this device, there is a drive shaft 16, which in turn is inside a sliding bearing, which enables the rotation of the drive shaft in both directions. Near the holder 45, there is the first lever 46 or action lever, which is fixed firmly to the drive shaft, i.e. with the rotating plane at a right-angle to the rotation axis of the drive shaft. At a specific place of the holder 45, which is fixed to the frame, there is a second lever 47, which is connected at one end with the holder through a rotating pin 49. The opposite ends of the action lever 46 and lever 47, which is fixed through a rotating pin 49 with the holder to the frame, are connected at two different points with a third lever 48 through rotating pins 50; 51. Lever 48, which is connected to other before-mentioned levers, is fixed at one end through a rotating pin 52 to a holder 53 at the window casement. Each drive shaft 16 is connected to two primary or action levers 46. The drive shaft 16 itself is connected to an independent driving motor, which is fixed to the frame. All levers in this system are arranged in such a way, that with each rotation of the drive shaft (to which the action lever is firmly fixed) and through the interaction of the levers and their connections, a simultaneous movement of the three levers of this system occurs, through which the third lever (fixed to the window casement) carries out a horizontal motion. For the sake of simplicity, the lever system described above is called the 'main lever system'.

Staggered to the main lever system is an identical lever system, identified here as an 'additional lever system' in order to differentiate it from the main lever system. The difference between both systems lies in the fact that the action lever 46 of the additional lever system is—at one end—fixed to the frame through a rotating pin 24 across a holder 45. The transfer of movement between the lever systems (the main lever system and the additional lever system) occurs through parallel arranged ropes and/or profile rods 37; 38. The parallel arranged ropes or the profile rods are connected in a suitable position to the action lever 46 of the main lever system and the action lever 46 of the additional lever system through a rotating pin 35; 36. The transfer of movement between both systems can also occur through connecting rods and toothed rods as shown in the original model with individual levers. The movement of the parallel arranged ropes or profile rods transfers the movement of the action lever of the main lever system to the relevant action lever of the additional lever system.

This configuration makes it possible for the movement of the drive shaft (via the drive motor) to create the movement of both action levers, which are connected with the main lever system. This creates a movement around the drive shaft, and the parallel arranged ropes or profile rods move the action lever of the additional lever system, which forwards this movement to its swivel fixed pivot brackets. Every window casement has at least four lever systems: two main lever systems with drive shafts and two additional lever systems, which are fixed in their holders to the frame or counter-frame of the window casement. The connection of the lever systems through parallel arranged ropes or profile rods enables a motion of the window casement parallel to the frame, making it possible to open and close the window.

To maximize energy saving and insulation, a ventilator mechanism is placed inside the unit and is visible between the two window casements. In one embodiment, the entire perimeter, the frame parts, the window encasements and the glass panels have a more homogeneous temperature, without superimposed mechanisms for the automatic opening of the window panels. Furthermore, by positioning pipelines for warming up and/or cooling down the inside of the windows, which are also visible through both glass panels, the frame parts, window casements and glass panels retain a homogeneous structure. Examples of such conduits heating and/or cooling the space between the two glass sheets or, more generally, the volume inside the window are identified in FIG. 3 with numerals 14' and 14". An even greater energy saving is achieved by using electric engines, which have a low energy requirement.

What is claimed is:

1. An energy saving window system comprising:

a frame extending along the perimeter of a window;

two movable window panes disposed on opposite sides of the frame to define a volume enclosed between the window panes and the frame;

an outer window casement coupled to one of the two window panes;

an inner window casement coupled to another of the two window panes, the inner window casement comprising a plurality of mating parts, a first mating part of the plurality of mating parts being affixed to the frame and a second mating part of the plurality of mating parts being movable from the first mating part;

an actuation system disposed within the volume, the actuation system comprising one or more independent drive shafts connected to one or more drive motors;

a plurality of action levers disposed in the volume, said plurality of action levers comprising a first group of action levers being situated in the upper part of the volume and a second group of action levers being situated in the lower part of the volume, said first group and said second group being symmetrical along a vertical axis, each action lever having a first end and a second end, each action lever in the first group being coupled at the first end to the first end of an action lever in the second group, each second end being coupled to the outer or inner casement so that the actuation system causes the action levers to rotate and the window panes to move one in relation to the other; and a plurality of multiple hinges each coupling one of the outer or inner window casements to the frame, the plurality of hinges being extendable and supporting the window panes when the window panes move one in relation to the other.

2. The energy saving window system of claim 1, wherein the frame has an I, U, L, C or T cross-sectional profile.

3. The energy saving window system of claim 2, wherein at least one of the outer and inner window casements is adjacent the I, U, L, C, or T profile.

4. The energy saving window system of claim 1, wherein at least part of the frame is part of a building frame.

5. The energy saving window system of claim 1, wherein each of the window panes is coupled to a pane profile.

6. The energy saving window system of claim 1, wherein the inner and outer casements are disposed behind the peripheral portion of the window panes.

7. The energy saving window system of claim 1, wherein the window panes are made of insulating glass.

8. The energy saving window system of claim 7, wherein the insulating glass has a variable heat transmission coefficient U of about 1.1-1.6 $W/m^{2\circ}$ K and a variable light transmission coefficient of about 68% to 77%.

9. The energy saving window system of claim 8, wherein the insulating glass comprises two parallel glass sheets spaced one from the other, further comprising a conduit disposed within a space between the two glass sheets, the conduit heating or cooling the space.

10. The energy saving window system of claim 9, wherein the conduit heats or cools the space by the temperature differential between the space and a liquid flowing in the conduit.

11. The energy saving window system of claim 1, wherein at least one of the window panes is a double glazing glass pane having a heat transmission coefficient of about 0.3-0.6 $W/m^{2\circ}$ K.

12. The energy saving window system of claim 1, wherein the outer and inner window casements have a heat transmission coefficient of about 0.6-0.8 $W/m^{2\circ}$ K.

13. The energy saving window system of claim 1, wherein the plurality of action levers is eight levers, and the first and second groups each comprise four action levers.

14. The energy saving window system of claim 1, wherein the plurality of action levers is two action levers in the first group and two action levers in the second group.

15. The energy saving window system of claim 1, wherein the plurality of mating parts are separable manually.

16. The energy saving window system of claim 1, wherein the multiple hinges each include two folding members connected to the one another, the outer or inner window casements, or the frame by rotating pins.

17. The energy saving window system of claim 1, wherein the one or more drive shafts are two drive shafts.

18. The energy saving window system of claim 1, wherein the one or more drive motors are coupled to the frame.

19. The energy saving window system of claim 1, wherein a rod or a rack and pinion system of the window system may be straight or curved.

20. The energy saving window system of claim 1, wherein a rod or a rope of the window system is two rods or two ropes.

21. The energy saving window system of claim 1, wherein the multiple hinges support the window panes by carrying the weight of the window panes.

22. The energy saving window system of claim 1, wherein the multiple hinges are situated in the upper part of the volume.

23. The energy saving window system of claim 1, wherein the window panes move one in relation to the other by moving while remaining one parallel to the other.

24. The energy saving window system of claim 1, wherein the plurality of action levers and multiple hinges are visible through the window panes at least partially.

25. The energy saving window system of claim 1, wherein each action lever is coupled to the inner or outer casements by via a piston system.

26. The energy saving window system of claim 1, wherein each action lever in the first group is coupled at the first end to the first end of an action lever in the second group by a rod, a rope, a rack and pinion system, or a gear and toothed rod system.

27. The energy saving window system of claim 26, wherein each action lever is coupled to the rod, the rope, the rack and pinion system, or the gear and toothed rod by a rotating pin, and wherein each action lever is slidably coupled to the inner or outer casements via a bracket with a rotating pin, said bracket sliding within a guide block.

28. The energy saving window system of claim 1, further comprising a conduit disposed in the volume, the conduit heating or cooling the volume.

29. The energy saving window system of claim 1, further comprising a first auxiliary lever and a second auxiliary lever, wherein the first auxiliary lever couples one of the action levers to the outer or inner window casement, and wherein the second auxiliary lever couples the first auxiliary lever to the frame.

30. The energy saving window system of claim 29, wherein the second auxiliary lever is coupled to the frame by being coupled to a holder coupled to the frame.

31. The energy saving window system of claim 29, wherein each action lever in the first group is coupled at the first end to the first end of an action lever in the second group by a rod, a rope, a rack and pinion system, or gear and toothed rod system.

32. The energy saving system of claim 1, wherein the plurality of action levers comprise action levers having different configurations.

33. The energy saving window system of claim 1, further comprising a blind or curtain disposed between the window panes.

34. The energy saving window system of claim 33, wherein the blind or curtain is made of a material having a variable thermal conductivity of about 0.00125-0.014 W/m° K.

35. The energy saving window system of claim 33, wherein the blind or curtain is motor-driven.

36. The energy saving window system of claim 1, wherein at least one of the window panes is made of insulating glass having two parallel glass sheets, wherein a blind or curtain is disposed between the two parallel glass sheets.

* * * * *